United States Patent [19]

Kramer

[11] Patent Number: 4,830,256

[45] Date of Patent: May 16, 1989

[54] STAPLER ACTUATION

[75] Inventor: William E. Kramer, Fairport, N.Y.

[73] Assignee: Xerox Corporation, Stamford, Conn.

[21] Appl. No.: 239,249

[22] Filed: Sep. 1, 1988

[51] Int. Cl.[4] ..... B25C 5/02

[52] U.S. Cl. ..... 227/124; 227/129; 227/143; 227/153; 227/155

[58] Field of Search ..... 227/30, 124, 129, 143, 227/153, 155; 173/81

[56] References Cited

U.S. PATENT DOCUMENTS 4,344,544 8/1982 Cross ..... 227/30

OTHER PUBLICATIONS

Xerox Disclosure Journal, May/Jun. 1987, pp. 133–134, William E. Kramer.

*Primary Examiner*—Frank T. Yost
*Assistant Examiner*—James L. Wolfe

[57] ABSTRACT

In a stapling system with a power driven stapler unit for stapling sheets together by clamping the sheets together with a clamper and driving a staple into the sheets with a staple driver while the sheets are clamped, and clinching the legs of the staple with a clincher, sequentially in that order; a single flexible cable with internal bights thereof operatively connecting with the clamper, the staple driver and the clincher, and with a free portion of the cable extending from the stapler unit and pulled with increasing movement and tension to provide the sole actuating power for the stapler unit wherein sequentially coupling pulleys engaged by the internal bights of the single flexible cable, and movement stops and/or resistance springs of different resistance forces, respectively operatively associated with the clamper, the staple driver and the clincher actuate them in that order, and wherein paired pulleys are arranged to multiply the forces available for the stapling from the cable tension.

5 Claims, 2 Drawing Sheets

STAPLER ACTUATION

This invention relates generally to staplers or stitchers for fastening sheets of paper or the like, such as the output of a copier, with staples inserted therein, hereinafter referred to as staplers, and more particularly to an improved and simplified system of actuation thereof in which the pulling or tensioning of a single wire or cable actuates or drives all of the active components thereof, such as clamping, staple driving and clinching.

There is disclosed herein a low cost and simple but reliable power driven stapler system.

The specific embodiment disclosed herein discloses a stapler in which all functions, including active clinching, may be effected by a flexible light-weight tensioning member. That is, by unidirectional pulling on a single cable with a simple drive means. Various cable pulling systems may be used. (Since these drives may be conventional, they need not be illustrated herein, and are encompassed by the symbolically illustrated actuating means.) This drive may be mounted at any convenient location because of the flexible cable pulling drive connection, and since only tension is required. That is, pulleys or other guides may be used to direct the actuated end of the cable to any desired location and angle.

Within the stapler unit of the embodiment disclosed herein, actuations of the various components are accomplished by simple pulleys, stops and/or different level spring loadings connecting the cable tension to the various components to provide the correct forces and the correct order of sequence of actuations for all the necessary stapling steps and motions. This is accomplished in a simple structure, which can be relatively light weight, even for heavy duty stapling for thick stacks outputted by a copier. The single light-weight but strong tension member and connecting pulleys on the different stapler members, connecting with bights or loops of the cable, replaces various of the usual plurality of cams, lever arms, and other heavy cantilever and compression members.

For example, as disclosed herein, a single pulling motion on the cable may sequentially accomplish: (a) movement of the stapler unit into the paper path into an operating position, (b) movement of at least one of two opposing set clamps or arms against opposite sides of the stack to clamp there between the stack to be stapled with further pulling (cable movement and tension force) on the same cable, (c) driving a staple through the stack with further pulling on the same cable, and (d) actuating a staple leg clincher to bend over and clinch the legs of the staple with further pulling on the same cable. Release of the cable releases the stapled set and allows all stapler components to automatically return to their initial positions.

This invention is not per se related to how staples are fed and could be used with any preformed staple or unformed wire feeder. However, there is also disclosed herein a simple staple feeding mechanism with a repositionable and movable one-way ratchet or pawl (riding on a shoe which is spring loaded towards the staple head) acting directly on the staple stick to maintain staple feeding into the stapler head. The shoe is automatically repositioned as the staples are used. This feeder could be used with almost any stapler irrespective of how the stapler is actuated.

Various types of staplers and drives and stapler loaders are known in the art. The following examples, and other art cited therein, are noted by way of background:

U.S. Pat. No. 2,881,438 to Winkler; U.S. Pat. No. 4,552,297 to Belanger et al; U.S. Pat. No. 4,151,944 to Picton; and U.S. Pat. No. 4,632,082 to Kurosawa. The latter three show staple stick pushers.

Of particular interest in this art is U.S. Pat. No. 4,344,554 issued Aug. 17, 1982 to T. R. Cross, which acknowledges the desirability of a common actuating member, but teaches a large and inherently heavy and complex-surfaced rotary cam disk member, and also requires a rotary intermittent drive thereof. Also noted in this regard is a Xerox Disclosure Journal publication of May/June 1987, p. 133–134, by the same William E. Kramer, in which, as noted therein at the end, all the various drive functions are being obtained from a single cam assembly.

An example of a stapler (80) which swings into a stapling position adjacent a copier output is particularly disclosed at Col. 13 and FIG. 8 of U.S. Pat. No. 4,554,185 issued Jan. 14, 1986, to T. J. Hamlin et al. That stapler unit pivots into the bin of a plural bin moving sorter to staple. On-line copier precollated set stapling with a pivotal stapler is disclosed in, e.g., FIG. 5 et al of U.S. Pat. No. 4,313,670 issued Feb. 2, 1982, to J. R. Caldwell. Optional manual set stapling with the same stapler on the copier is shown in Xerox XDJ Publication, Vol. 8, No. 4, July/August, 1983, p. 309–311.

A feature of the specific embodiment disclosed herein is to provide a stapling system with a power driven stapler unit for stapling sheets together by clamping the sheets together with a clamper and driving a staple into the sheets with a staple driver while the sheets are clamped, and clinching the legs of the staple with a clincher, sequentially in that order, and means for loading stapling material into the stapling unit, the improvement comprising: a single flexible cable with internal bights thereof operatively connecting with the clamper, the staple driver and the clincher, and with a free portion of the cable extending from the stapler unit; a single pulling means for pulling on the free portion of the cable with increasing movement and tension to provide the sole actuating power for the stapler unit; sequential coupling means operatively connecting the internal bights of the single flexible cable with the clamper, the staple driver and the clincher for sequential actuation of the clamper, the staple driver and the clincher by the single pulling means pulling on the free portion of the cable with increasing movement and tension.

Further features provided by the system disclosed herein, individually or in combination, include those wherein the pulling means for pulling on the free portion of the cable initially pulls the stapler unit into a stapling position before the actuation of the other components thereof; wherein the sequential coupling means comprises pulleys engaged by the internal bights of the single flexible cable, and movement stops and/or resistance springs of different resistance forces, respectively operatively associated with the clamper, the staple driver and the clincher to actuate them in that order by requiring increasing movement and tension in the cable to respectively actuate them; wherein paired pulleys are arranged to multiply the forces available for the stapling from the cable tension; wherein the pulling means for pulling on the free portion of the cable initially pivots the stapler unit into a stapling position before the actuation of the clamper, the staple driver and the clincher.

All references cited in this specification, and their references, are incorporated by reference herein where appropriate for appropriate teaching of additional or alternative details, features, and/or technical background.

Various of the above-mentioned and further features and advantages will be apparent from the specific apparatus and its operation described in the example below. The present invention will be better understood by reference to this description of this embodiment thereof, including the drawing figures (approximately to scale) wherein.

Describing now in further detail the example illustrated in the Figures, a stapler unit 10 is shown. The components thereof may be conventional other than as described herein. A single pulling motion on the free end 12*a* of a thin wire cable 12, here terminated at its other end 12*b* at point 14 in stapler unit 10, accomplishes all of the stapling functions, as described below, sequentially in the order described below. Here this cable pulling is schematically shown by a cable pulling means 100, which as noted above, can be almost any simple drive means. Various cable pulling systems may be used. The free end of this single cable 12 may be pulled by an electric motor driven reel, or by a pneumatic or hydraulic piston, or the like. If desired, a flywheel or other kinetic energy assist or a spring energy storage assist may be utilized. As noted in optional step 1 below, this pulling of the cable free end 12*a* may be used to initially swing in the stapler unit into an operating position, against any suitable retracting spring force, if the stapler unit 10 is of a type that swings into an operating position.

Figure 1:
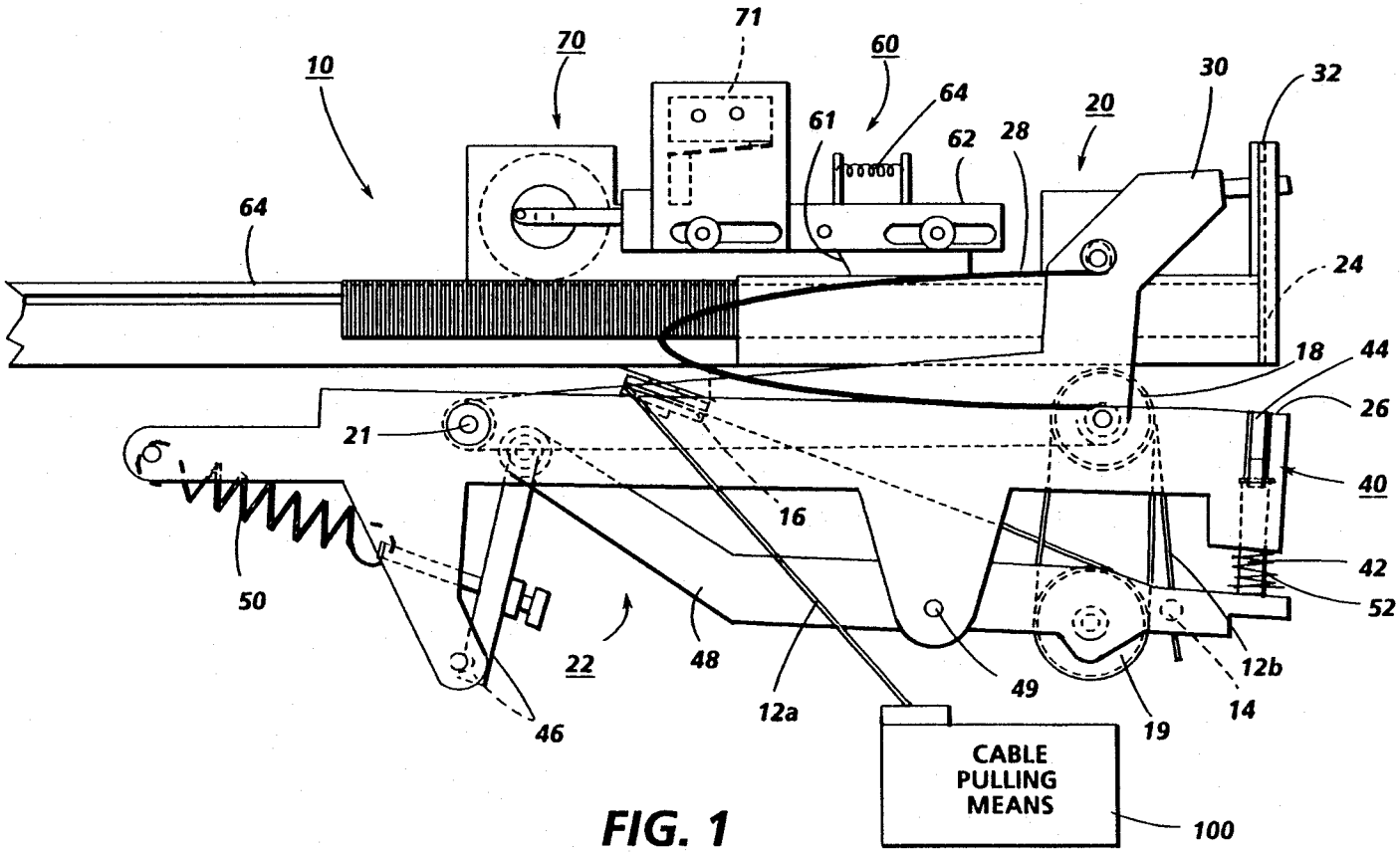
FIG. 1 is a side view of one stapler unit embodiment in accordance with the invention.
Figure 2:
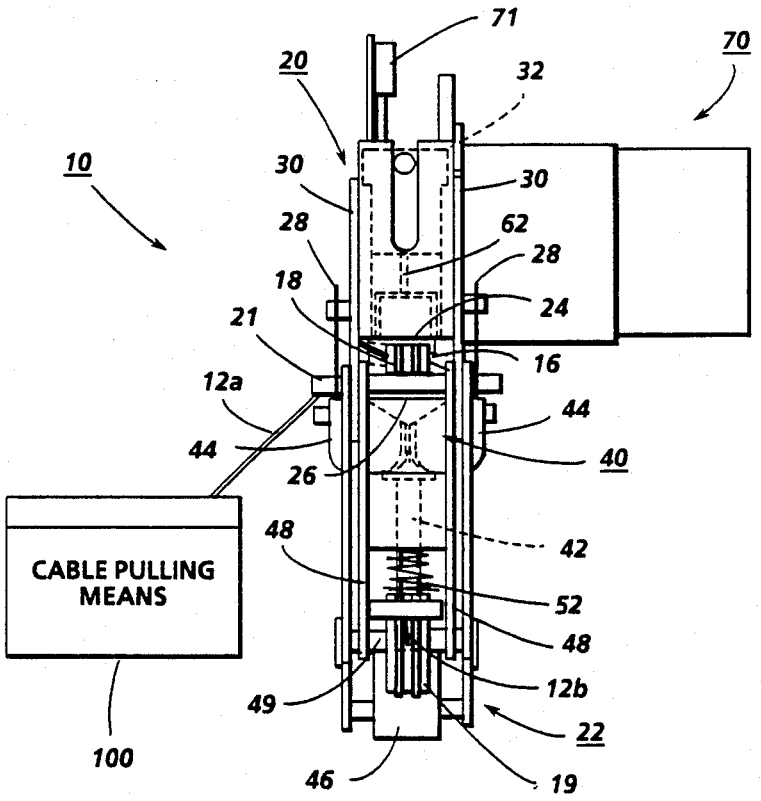
FIG. 2 is a front end view of the stapler unit of FIG. 1.
Figure 3:
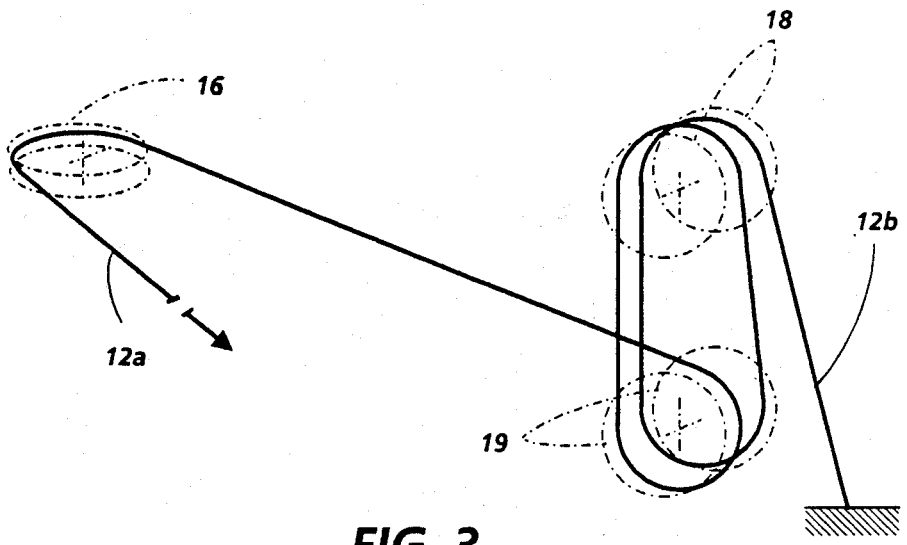
FIG. 3 is a partial side view of only the pulleys and cable per se.

1. Pivotal movement of the stapler unit 10 into the paper path of a copier (as shown in the cited and other prior art), or other desired operating position, may be provided about any desired axis of rotation in the plane of FIG. 1, providing that axis is spaced from the initial pulley 16, by the initial and lowest tension pulling of the cable in at least a partially orthogonal axis. A stop preventing further stapler unit 10 pivotal movement then causes further tension applied to the cable to be applied internally of the stapler unit 10 to actuate its components by transmitting its tensioning forces thereto as described below.

2. Clamping movement of at least one of two opposing set clamps or arms against opposite sides of the stack to clamp therebetween the stack to be stapled is accomplished with further pulling (cable movement and tension force) on the same cable free end 12*a*. Here an upper arm unit 20 and a lower arm unit 22 are pivotally connected to one another at pin 21. Clamping movement therebetween is accomplished by tensioning bights of the cable 12 plurally wrapped between two pairs of pulleys 18 and 19 which are thereby pulled towards one another with a force multiplying advantage. I.e., the paired pulleys 18 and 19 act as a block and tackle. The pulleys 18 here are on upper arm unit 20 and pull it down towards lower arm unit 22, thereby bringing its upper jaw and stapling head 24 down on top of a stack of sheets, while the bottom of that stack is engaged by anvil 26 on lower arm unit 22 to which pulley 19 is axially fastened. That provides the stop and end point for this clamping movement, which will automatically vary depending on the stack thickness. This clamping movement is initiated and completed prior to the others below because it is only relatively lightly resisted by the elongated bow springs 28 compressed between upper arm unit 20 and lower arm unit 22 on each side thereof.

3. Once this clamping movement is completed, as indicated above, further pulling on the same cable 12 similarly causes driving of a staple through the stack by further movement of staple driving arm 30, which is now moving relative to the rest of the upper arm unit 20 rather than with it. This is due to pulleys 18 being mounted to this part 30 of the upper arm unit 20, and staple driving arm 30 being independently pivotally mounted with the upper arm unit 20 at pin 21. In the clamping movement described above the operative end of the staple driving arm 30 is held up against a stop 32 on stapling head 24 of the upper arm unit 20 by the bow springs 28 engaging the staple driving arm 30. Once clamping is completed, the further pulling between pulleys 18 and 19 by the cable 12 further compresses the bow springs 28 and pulls the staple driving arm 30 down from the stop 32, since further movement of the rest of the upper arm unit 20 is now resisted by the stack and the anvil 26. This stapling head 24 conventionally drives the staple into and through the stack.

4. Further pulling on the same cable 12 free end 12*a* actuates an otherwise conventional staple leg clincher unit 40 to bend over and clinch the legs of the staple. Here, the pin 42 pivotally actuating the two clincher arms 44 is only driven after the tension force on the cable has risen to a substantially higher level, such that a latch or cam 46 engaging the opposite end of actuating lever arm 48 is forced open against the force of latching spring 50, to allow lever arm 48 to independently rotate about pivot 49 and drive up the pin 42 by the cable tension on pulley 19. Lever arm 48 is pivotally mounted to, at 49, and part of, lower arm unit 22. A spring 52 on pin 42 restores it to its initial position after clinching is completed and the cable tension is released.

Instead of a tension released latch 46, a stronger spring could be used instead, with similar or other positional leverage on the arm 48 so as not to allow clinching 40 actuation until after sufficient force has been provided for stapling a stack of maximum design thickness and staple penetration resistance.

5. Release of the cable tension allows all stapler components to automatically return to their initial positions by the above described spring forces 28,52 and releases the stapled set.

This above described stapler actuating system has nothing to do per se with how staples are fed, and could be used with any preformed staple or wire feeder. However, there is also disclosed herein a simple staple feeding mechanism 60 with a repositionable and movable one-way ratchet or pawl 61 on a small shoe 62 riding in a parallel track over the staple guide 64 on upper arm unit 20. Here this pawl 61 is a simple cantilevered leaf spring. The shoe 62 and thus pawl 61 is spring loaded 64 towards the stapling head 24. The free end of pawl 61 directly engages the staple stick to maintained staple feeding into the stapler head by spring 64. Pawl 61 also functions as a one way clutch, due to its upstream angle of engagement with the staple stick and the rough surface thereof. Staples can be pushed in along their guide 64 past pawl 61 towards the stapling head 24 but not released back.

This staple stick feeder 60 could be used with almost any stapler. As opposed to a conventional rear-spring and follower type of staple stick feeder or advancer, this stapler stick advancer system 60 can take any length of staple stick, and does not require opening the stapler and/or retracting a spring and follower to load a new stick. Thus, new sticks can be loaded in continuously, as from a magazine, by gravity or a magnetic wheel, or other new stick loader without interrupting the operation. The latter is know per se in the art, but with more complicated stick feeding mechanisms.

The shoe 62 may be automatically repositioned back upstream occasionally as staples are used. For example, a small motor and cam system 70 with a limit switch control 71 as shown may be used to retract back the spring-loaded ratchet shoe 62 by a given distance when it moves up (forward) to near the end of its travel. However, preferably this reset movement could instead be driven off the stapler operation motion or actuation itself by a cam on one movable portion of the stapler unit, or by a ratchet, and/or an overdrive slip clutch. Also, it could be combined with another one way clutch or frictional member to resist inadvertent rearwards movement of the stick during this cyclic retraction of the shoe 62.

While the embodiment disclosed herein is preferred, it will be appreciated from this teaching that various alternatives, modifications, variations or improvements therein may be made by those skilled in the art, which are intended to be encompassed by the following claims.

I claim:

1. In a stapling system with a power driven stapler unit for stapling sheets together by clamping the sheets together with a clamper and driving a staple into the sheets with a staple driver while the sheets are clamped, and clinching the legs of the staple with a clincher, sequentially in that order, and means for loading stapling material into the stapling unit, the improvement comprising:

a single flexible cable with internal bights thereof operatively connecting with said clamper, said staple driver and said clincher, and with a free portion of said cable extending from said stapler unit;

a single pulling means for pulling on said free portion of said cable with increasing movement and tension to provide the sole actuating power for said stapler unit;

sequential coupling means operatively connecting said internal bights of said single flexible cable with said clamper, said staple driver and said clincher for sequential actuation of said clamper, said staple driver and said clincher by said single pulling means pulling on said free portion of said cable with increasing movement and tension.

2. The stapling system of claim 1 wherein said pulling means for pulling on said free portion of said cable initially pulls said stapler unit into a stapling position before the actuation of the other said components thereof.

3. The stapling system of claim 1 wherein said sequential coupling means comprises pulleys engaged by said internal bights of said single flexible cable, and movement stops and/or resistance springs of different resistance forces, respectively operatively associated with said clamper, said staple driver and said clincher to actuate them in that order by requiring increasing movement and tension in said cable to respectively actuate them.

4. The stapling system of claim 3 wherein paired pulleys are arranged to multiply the forces available for said stapling from said cable tension.

5. The stapling system of claim 4 wherein said pulling means for pulling on said free portion of said cable initially pivots said stapler unit into a stapling position before the actuation of said clamper, said staple driver and said clincher.

* * * * *